US008721467B1

(12) United States Patent
Ackerman

(10) Patent No.: US 8,721,467 B1
(45) Date of Patent: May 13, 2014

(54) FULL SWING GOLF SWING TRAINER

(71) Applicant: Raymond Lee Ackerman, Edisto Beach, SC (US)

(72) Inventor: Raymond Lee Ackerman, Edisto Beach, SC (US)

( * ) Notice: Subject to any disclaimer, the term of this patent is extended or adjusted under 35 U.S.C. 154(b) by 0 days.

(21) Appl. No.: 13/902,400

(22) Filed: May 24, 2013

(51) Int. Cl.
*A63B 69/36* (2006.01)

(52) U.S. Cl.
USPC ..... 473/257; 473/266

(58) Field of Classification Search
USPC ..... 473/219, 227, 257, 261, 264, 265, 269, 473/270–273
See application file for complete search history.

(56) References Cited

U.S. PATENT DOCUMENTS

| | | | | |
|---|---|---|---|---|
| 3,482,838 | A * | 12/1969 | Gibson et al. | 473/264 |
| 6,949,030 | B1 * | 9/2005 | Gauer | 473/257 |
| 7,172,515 | B2 * | 2/2007 | Costa et al. | 473/261 |
| 7,431,661 | B1 * | 10/2008 | Cailey | 473/257 |
| 7,980,958 | B1 * | 7/2011 | Ford | 473/266 |

* cited by examiner

*Primary Examiner* — Nini Legesse
(74) *Attorney, Agent, or Firm* — Gregory Finch

(57) ABSTRACT

This swing trainer is a full swing trainer designed to produce what is known in golf vernacular as "the classic swing". Its attributes are as follows: It trains both the back swing and the forward swing. The golfer can hit balls with it at a driving range, or practice his swing in his garage or yard without actually hitting balls. It assembles in less than one minute and can be broken down and transported in a canvas "chair-type" bag. It adjusts for the skill and the height of the golfer, and for right or left-handed golfers. When the golf club is properly gripped and swung along the paths dictated by the guidelines of this swing trainer, an ideal ball flight is produced. Its most effective feature is the visual images provided for the golfer of the proper paths for the club head.

8 Claims, 1 Drawing Sheet

FULL SWING GOLF SWING TRAINER

CROSS REFERENCE TO RELATED APPLICATIONS

Not Applicable

BACK GROUND OF INVENTION

The golf swing is one of the most difficult of all athletic efforts to master. Volumes are written on how to develop a great golf swing. Jack Nicklaus, in his description of the golf swing, mentions twenty-three different body parts involved in the proper golf swing. There are commercially available hundreds if not thousands of all types of golf swing trainers. They run the gamut from small devices that attach to a golf club to large tubular devices that you stand in and swing the club along the tube.

In my research, I have discovered that most full swing trainers are deficient in one way or another. They are for only the back swing or only the forward swing. They are very expensive costing as much as $900. They attach to your club, thereby impeding a free flowing swing. They are designed to have the club ride along their surface, thereby making it difficult to actually hit a ball with it. They are too big to be transported easily. They are not adjustable for the golfer's skill level. They are not adaptable for the right or left hand golfer, nor are they adjustable for the height of the golfer. If a golfer cannot actually hit balls with his training device and observe the ball flight, then the effectiveness of the device in actually producing a good golf swing is suspect.

My Classic Swing Trainer is designed to solve all of the aforementioned problems and when used correctly will produce a classic golf swing that will propel the golf ball on a desirable trajectory. Specifically, it trains both the back and the forward swing. It is adjustable for the golfer's height and the present skill level of the golfer. It is capable of training the swing of both right and left-handed golfers. It can be assembled in less than one minute and dissembled into pieces that fit into a "chair-type" canvas bag for easy transporting. When set up at a driving range, the golfer can actually hit balls with it with no interference by it, nor any interaction with his golf club. It can also be set up in the golfer's garage or yard and be used to train his swing by "dry" swinging without a ball being struck. If my invention is made commercially available, I expect it would sell for less than $150.00. My invention has been tested by two PGA professionals and a scratch handicap amateur golfer and both have testified that it works to produce a very desirable flight of the golf ball.

BRIEF SUMMARY OF THE INVENTION

The Classic Swing Trainer is a full-swing trainer made mostly with ½ inch PVC piping and fittings mounted on a five foot long plastic base. The pieces are so arranged to provide the golfer a visual pattern for a proper back swing and a proper forward swing. It provides a physical barrier to a back swing that is too upright and an audible indicator to tell the golfer if his back swing is too flat. On the forward swing, there is presented to the golfer a visual bright yellow cone or funnel to direct his club head correctly, back to the ball. There is also a physical barrier to what is called an "over the top" move that produces a slicing ball trajectory, the dominant error for most amateur golfers.

DETAILED DESCRIPTION OF THE INVENTION

Figures 1, 2, 3:
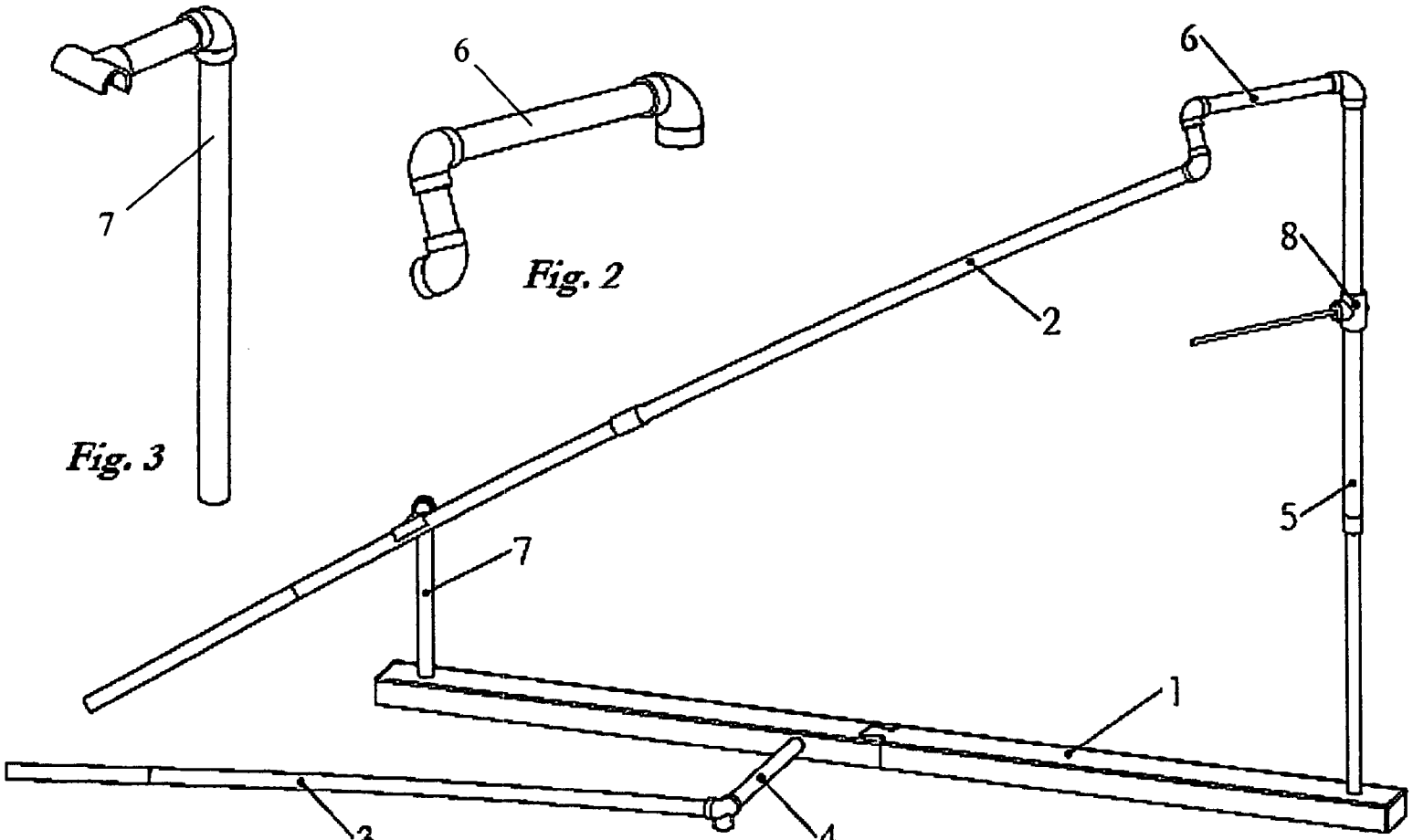
FIG. 1 is a diametric view of the fully assembled swing trainer showing it as near as possible from the golfer's view point. It has eight parts identified by reference numbers that are described in the following detailed description portion of this application. All reference numbers herein are shown in FIG. 1 only.
FIG. 2 is a detail view of the rear long arc support piece. It is included to give a better view of the angular relationship of the five separate pieces that comprise this rear support piece.
FIG. 3 is a detail view of the forward long arc support piece. It is included to give a better view of the connecting piece that snaps onto the long arc.

The following describes how the various components of the invention are made: The base (1) is made from polypropylene or ABS. It is machined to produce the modified dovetail fit of the two halves. The end has a ⅞ inch hole drilled through vertically one inch from the end. The right end has a hole tapped for a ¾ inch standard acme thread one inch from the end to receive the rear telescoping pole (5). If manufactured in large quantities, the base would more economically be made with an injection molding process using a low density polymer such as ABS or polypropylene.

The long arc (2) and the ground level arc (3) are both made from schedule 40 PVC electrical conduit. (They can also be made from schedule 40 PVC water pipe; however the electrical conduit is preferable due to the existing "bell" on one end used to join the two halves of the long arc together). When the two pieces of the long arc (2) are connected, the bell joint is then pressed into an oval shape with a vise or press to prevent the pieces from turning after bending. The ground level arc (3) is attached to its adjusting rod (4) by a 3-way PVC elbow. This 3-way elbow acts as a leg to prevent whole device from falling forward. The long arc (2) and the ground level arc (3) are bent similarly by placing them into a three point frame that bends them into the desired curvature as shown in FIG. 1. This process takes approximately 24 hours to set the curves.

The rear support pole (5) is an off-the-shelf Mr. Long Arm Model 3204 (or equivalent) two foot to four foot extension pole used for an extension arm for paint rollers and brushes.

The rear long arc support piece (6) in FIG. 1 is detailed in FIG. 2. It is made by combining the 8¾ inch piece and 2 inch piece of PVC with the three elbows as shown in FIG. 3. It is glued into this fixed configuration as indicated as shown in FIG. 3. When this piece is oriented such that the 2 inch piece of PVC is vertical and the 8¾ inch piece points away from you, the ½ inch elbow on the end is pointed toward you and rotated to the left 25 degrees and the ¾×½ inch elbow is pointing down and 35 degrees to the left of vertical. Because these precise angles must be reversed in the left-hand set up, a separate piece, glued in the correct configuration, would be provided for a left hand set up if the device is made commercially available.

The forward long arc support piece (7) shown in FIG. 1 is detailed in FIG. 3. It is assembled using the 9½ inch piece of PVC, the ½ inch elbow, and modified ½ inch tee. The ½ inch tee is drill out to ⅞ inch inside diameter, and then a portion is cut out along its long axis to allow an opening of 13/16 of an inch that points downward when in place. This allows for the long arc to be snapped into the tee so that if struck by the club head, the long arc simply falls out rather than breaking. The long arc is marked to indicate the location where the forward support piece is to be snapped onto it. The whole support piece also turns freely in the ⅞ inch hole to allow it to spin out of the way rather than break, if struck by the club. The elbow on the forward long arc support is glued on both ends. The modified tee is allowed to turn freely, as a rotation is necessary when the swing trainer is set up for a left-handed golfer.

The flat swing indicator is a 1×½ inch PVC tee drilled out to a one inch diameter all the way through. A ½ inch plug is glued into place and a ¼ inch hole is drilled through the center of the plug. A nine inch long ¼ inch plastic tube (standard plumbing tubing) is inserted into the ¼ inch hole making a snug fit. A #8-32 thumb screw is screwed into a hole tapered for a #8-32 screw in the middle of the tee on the side opposite the plug. This thumb screw holds the flat swing indicator in the desired position on the pole allowing the back swing opening to be as large or as small as the skill of the golfer may dictate.

The two arcs are painted iridescent yellow. All other parts are painted as near as possible to match the color of green grass.

The swing trainer would be sold disassembled with all pieces fitting into a canvas "chair-type" bag. It can be assembled without tools in less than one minute. The following steps describe the assembly:

1. Snap the two pieces of the base together with the threaded hole for the support pole on the right side. (right and left directions given herein are from the perspective of a right-handed golfer).
2. Screw in rear support pole with flat swing indicator in place. Adjust pole initially so that the top is 2 inches below waist height. (After hitting balls, the height can be adjusted to achieve the desired ball flight.)
3. Combine two pieces of long arc with bell end on right hand piece.
4. Insert forward long arc support piece in to ⅞ inch hole on left end of base.
5. Snap left end of long arc into forward support piece at the indicated position on long arc. (This ensures proper position of rear long support on top of support pole.)
6. Place rear long arc support piece on support pole by pressing the one inch opening onto the top of the pole. Its initial position should point the support piece toward the front and approximately 45 degrees to the left.
7. Insert the long arc right end into the ½ inch elbow on the end of the rear long arc support piece.
8. Adjust the flat swing indicator tubing at the desired height and directly beneath the rear long arc support piece.
9. Insert the 14 inch adjusting rod into the 3-way elbow of the ground level arc so that the third unused opening is pointed down and the arc curves toward the golfer.
10. Insert the 14 inch adjusting rod into the horizontal ⅞ inch hole in the base, until the end is flush with the far side of the base.

This initial set up produces an approximate 9 inch opening between the ends of the long arc, which is just touching the ground, and the ground level arc. By sliding the adjusting rod in or out, the opening is made smaller or larger to fit the current skill of the golfer, as the middle of this opening is where the ball is teed.

To use the Classic Swing Trainer, the golfer does the following:

He rotates the base of the swing trainer until the end of the long arc is pointing down the target line. He tees a ball midway between the ends of the two arcs. He takes his stance with a driver as he would normally to hit the ball down the chosen target line. The golfer starts his back swing with his shoulders, taking the club back straight for the first 12 to 14 inches producing what is known as a "one piece take away". When he does this, the club will then, at about 25 inches back, come under the long arc and continue to follow under the arc until it passes through the gap between the rear long arc support piece and the flat swing indicator. When the club exits this opening, the momentum of the shoulder turn and lifting arms causes the club to continue to a proper back swing position. From there, the golfer now swings the club back down so that the club head passes down through the bright yellow visual cone made by the two arc pieces to strike the ball with a square club face and a proper inside approach to the ball.

This set up describes the use of a driver for tee shots. By moving the ball back further between the arcs, one can hit shorter clubs with the described swing trainer. The ball position should be such that the club head passes through the back swing opening as described above.

Until the golfer is skilled enough to not hit the long arc on his back swing, a piece of a yellow foam noodle (child's swimming toy) is placed over the right half of the long arc to protect the golfer's club from damage. The noodle is not shown in drawings.

I claim:

1. A golf swing training apparatus comprising:

an elongated base;

a telescoping pole coupled to an end portion of the elongated base;

a support pole coupled to a portion of the elongated base opposite the telescoping pole;

a first arc piece extending between the telescoping pole and the support pole, the first arc piece being at least four feet in length;

an adjusting rod slidably coupled to the elongated base at a substantial midpoint, the adjusting rod being substantially perpendicular to the elongated base; and, a second arc piece removably coupled to the adjusting rod, the second arc piece being a length less than that of the first arc piece.

2. The golf swing training apparatus of claim 1 further comprising a flat swing indicator slidably coupled to the telescoping pole, the flat swing indicator comprising a tubular collar, a tubular protrusion extending substantially horizontally from the tubular collar, and a thumb screw threaded from an exterior portion of the tubular collar to an interior portion of the tubular collar.

3. The golf swing training apparatus of claim 1 further comprising a support piece removably coupled at a first end to a terminal portion of the first arc piece, and removably coupled at a second end to a terminal portion of the telescoping pole.

4. The golf swing training apparatus of claim 1 further comprising a foam sleeve removably coupled to a portion of the first arc piece.

5. The golf swing training apparatus of claim 1 wherein the apparatus is assembled substantially from a material selected from the group consisting of polypropylene plastic, polyvinyl chloride, and polymeric material.

6. The golf swing training apparatus of claim 1 further comprising a three-way elbow, the three-way elbow being removably coupled to the adjusting rod and the second arc piece at substantially a 90 degree angle.

7. The golf swing training apparatus of claim 1 wherein the elongated base consists of a first base portion and a second base portion.

8. The golf swing training apparatus of claim 1 wherein a forward portion of the first arc piece is selectively coupled to the support pole with a snap fitting.

* * * * *